United States Patent [19]

Kichijyo

[11] 4,414,866

[45] Nov. 15, 1983

[54] CAP REMOVER

[76] Inventor: Hiroshi Kichijyo, 1563, Oaza Koshibe, Oyodo-cho, Yoshino-gun, Nara Prefecture, Japan

[21] Appl. No.: 225,321

[22] Filed: Jan. 15, 1981

[30] Foreign Application Priority Data

| | | | |
|---|---|---|---|
| Feb. 6, 1980 | [JP] | Japan | 55-14050 |
| May 30, 1980 | [JP] | Japan | 55-72908 |
| Nov. 26, 1980 | [JP] | Japan | 55-167141 |

[51] Int. Cl.[3] ..... B67B /700

[52] U.S. Cl. ..... 81/3.46 R

[58] Field of Search ..... 81/3.3 A, 3.34, 3.37, 81/3.38, 3.46 R, 3.46 A, 3.42, 3.44

[56] References Cited

U.S. PATENT DOCUMENTS

| | | | |
|---|---|---|---|
| 1,787,018 | 12/1930 | Porz | 81/3.37 X |
| 2,155,947 | 4/1939 | Low | 81/3.46 R |
| 2,440,485 | 4/1948 | Ranseen | 81/3.46 R |
| 2,551,511 | 5/1951 | Talbot | 81/3.46 R |
| 2,593,358 | 4/1952 | Sprich | 81/3.46 R |
| 2,961,902 | 11/1960 | Chapman | 81/3.46 A |

*Primary Examiner*—James G. Smith

*Attorney, Agent, or Firm*—Wenderoth, Lind & Ponack

[57] ABSTRACT

A cap remover for uncapping a bottle easily only by pushing down a pusher or a lever or by gripping a lever. The lever is pivotally mouted to a main body having an opening for receiving and holding the cap and mouth of the bottle. A vertically extending hooking member provided with a hook portion at its bottom end for engaging the undersurface of the rim of the cap is pivotally mounted at its top end to an end of the lever so that pivoting of the lever lifts the hooking member and prys the cap from the bottle. Uncapping can be effected by one hand, without tilting or tumbling the bottle and spilling contents.

12 Claims, 12 Drawing Figures

CAP REMOVER

BACKGROUND OF THE INVENTION

This invention relates to a cap opener for uncapping easily a bottle of beer, soft drink or other liquid provisions or articles.

For removing a crown cap of a bottle filled with a soft drink, juice, beer or the like, a cap remover with a hole at one end, namely, a bottle opener of the lever type, is generally used. When uncapping with such a cap remover, a part of the hole of the cap remover is applied to a part of the under rim of a crown cap and then with a handle part of the cap remover as a dynamic point, prying force is applied to a crown cap. In this case, however, it is sometimes experienced that by the shock in uncapping, a bottle is tumbled, a bottle is tilted and contents are spilled, or the cap flies off. In addition, it is inconvenient to use both hands of uncapping, namely, holding a bottle with one hand and manipulating a cap remover with the other hand.

SUMMARY AND OBJECTS OF THE INVENTION

The present invention has for its object to eliminate the above disadvantages of a conventional cap remover and provides a novel cap remover with which a bottle can be uncapped easily either by pushing it down lightly from above or by gripping it lightly, using only one hand and without the danger of tumbling or tilting the bottle by the shock in uncapping.

BRIEF DESCRIPTION OF THE DRAWINGS

The nature and advantages of the present invention will be understood more clearly from the following descriptions made with reference to several embodiments and the accompanying drawings, in which.

DETAILED DESCRIPTION OF THE PREFERRED EMBODIMENTS

Figure 1:
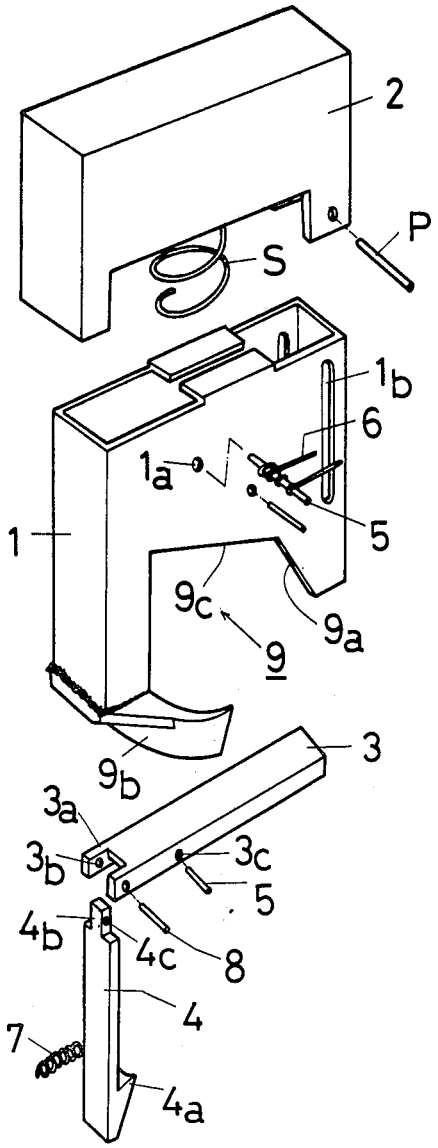
FIG. 1 is an exploded perspective view of one embodiment of the present invention of a cap remover of the outer casing pushing down type, comprising an outer casing and an inner casing.

Identical reference numerals in the drawings and referred to below identify similar or corresponding elements.

In the drawings, numeral 1 denotes a cap remover proper (main body) of rectangular casing type. In the embodiment shown in FIGS. 1–3, a pusher 2 formed in the shape of a casing having a rectangular cross-section is vertically slidably mounted on the cap remover proper 1, a cap inserting groove of trapezoidal cutout shape 9 being formed at the lower rim of the cap remover proper 1 so that a cap to be removed can be inserted into this groove 9. The pusher 2 which is vertically slidably mounted on the outer circumference of the cap remover proper 1 is a slightly larger size than the cap remover proper 1 so that it can slide smoothly on the latter. A support axle 5 extends through opposing holes 1*a* in both side plates of the cap remover proper 1 and is fixed by welding so that it cannot slip out. A lever 3 inserted in the cap remover proper 1 is pivotally held by the support axle 5. The lever 3 is so designed that it has the desired leverage and the strength to stand the load applied in uncapping. Preferably, the lever 3 is a square bar having an engaging portion 3*a* of fork shape at one end thereof. The engaging portion 3*a* is pivotally secured to a hook member 4. In the engaging portion 3*a* is provided a pin hole 3*b* through which a pin 8 extends horizontally. A hole 3*c* through which the support axis 5 extends is formed in the lever 3 at such a position that the desired leverage is obtained. The hook member 4 which is pivotally secured to the lever 3 through the medium of the pin 8 is metal of square bar shape and carries an engaging portion 4*b* with a pin hole 4*c* through which the pin 8 is passed to secure it pivotally to the fork-shaped engaging portion 3*a* of the lever 3. A nail-like hook 4*a* which in use hooks the undersurface of the rim of a crown cap to be removed is formed at the lower end of the hook member 4. Since the hook 4*a* will wear due to repeated uncapping, it is desired that the hook 4*a* is made of steel or is subjected to tempering for improving abrasion-resistance.

The hook member 4 is fitted in a vertical groove formed at the inner surface of one side of the cap remover proper 1 hook 4*a* is projected partially or entirely from the lower end of the cap remover proper 1. The length of the hook member 4 is so determined that whenever a crown cap at the mouth of a bottle is inserted in crown inserting groove 9, the hook 4*a* engages with a part of the undersurface of the rim of the crown cap, as illustrated in FIG. 3. A pushing leaf spring 7 is interposed between the inner surface of the vertical groove in cap remover proper 1 and the confronting side of the hook member 4 so that the hook 4*a* is forced to project toward the crown cap as is illustrated in FIG. 2.

The crown inserting groove 9 comprises internal surfaces therein including an inner end face 9*a* which inclines in such a fashion that it narrows upwardly, a bottle mouth contacting face 9*b* which opposes the inner end face 9*a* and an inner end edge (inner face) 9*c* connecting the both faces 9*a* and 9*b*. The inner end edge 9*c* is inclined in such a fashion that the contacting face side is greater in height. The bottle mouth contacting face 9*b* may be made of a different material of arcuate shape and may be welded to the lower front and rear sides of the cap remover proper 1, as illustrated in FIG. 1 and FIG. 3, or, as shown in FIG. 4 and the following figures it may be formed by making the lower end of one side of the cap remover proper 1 project a little inwardly. A device for assuring that the pusher 2 slides smoothly in a vertical direction is provided in the cap remover proper 1, namely, a pushing down pin P which extends and is fixed to an end portion of the front and rear side plates of the pusher 2 extends through slits 1*b* which extend vertically in both the front and rear side plates of the cap remover proper 1. With this construction, the pusher 2 can slide relative to the cap remover proper 1 but is prevented from slipping out of the cap remover proper 1, and also the pushing down pin P depresses an end portion of the lever 3.

Wound around the support axle 5 is a kick spring 6 by which the depressed lever 3 is restored automatically to its original state upon releasing the pusher 2 from pressing thereon. Restoration of the pusher 2 can be effected by the kick spring 6 or by or in combination with a coil spring S which is interposed between the top part of the cap remover proper 1 and the inner surface of the pusher 2 as shown in FIG. 2.

Figure 2:
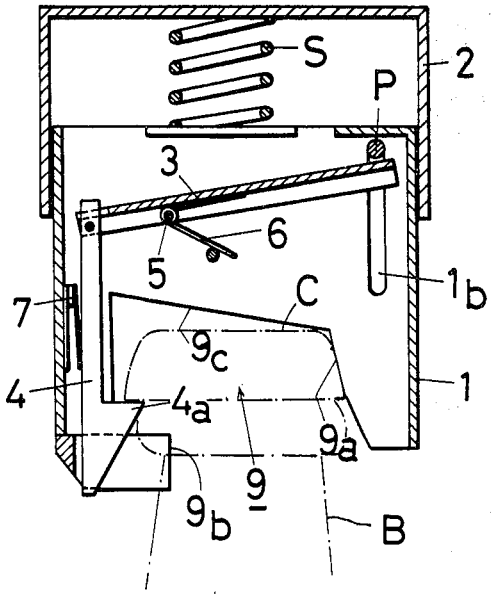
FIG. 2 is a longitudinal section of the cap remover shown disassembled in FIG. 1 with the coil spring replaced by a leaf spring.
Figure 3:
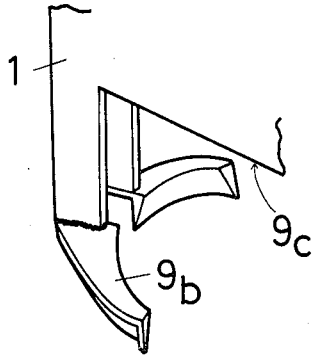
FIG. 3 is a perspective view of a part of the invention to grasp the outer circumference of the mouth of a bottle.
Figure 4:
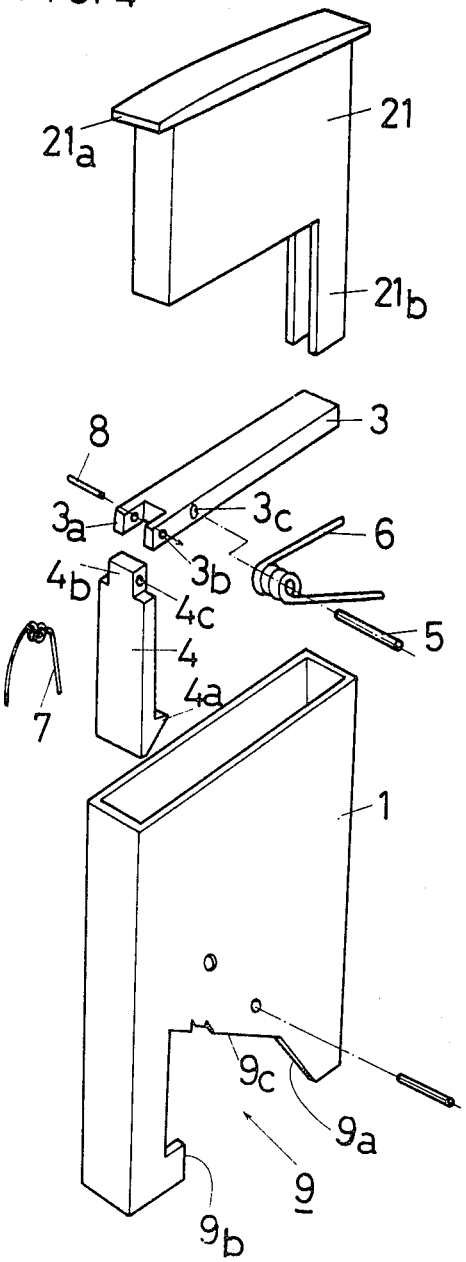
FIG. 4 is an exploded perspective view of a modification of the embodiment shown in FIG. 1, being a cap remover of the inner casing pushing down type.

When uncapping a bottle B with the cap remover embodied in FIG. 1–FIG. 3, firstly cap remover proper 1 is put on the top of a crown cap as shown in FIG. 3 so that the crown cap is inserted into the crown inserting groove 9. At this time, the outer circumferential surface of the bottle mouth is pressed partly against the bottle contacting surface 9*b* and the outer circumference of the crown cap on the opposite side and thus the crown cap and the bottle are held in the groove 9. This is effected easily and accurately because the inner end face 9*a* is inclined in such a fashion that the groove 9 narrows in an upward direction. At the same time, the hook 4*a* at the lower end of the crown hooking member 4 is pushed toward the undersurface of rim of the crown cap by means of the leaf spring 7 and hooks the crown cap. Then, upon pushing down the pusher 2 by the palm of the hand, the spring S is compressed and as a result, the pushing down pin P is depressed and the lever 3 pivots with the support axle 5 as a fulcrum, whereupon the hooking member 4 pivotally secured to the other end of the lever 3 is lifted up and the hook 4*a* engaging with the under rim of the crown cap pries open the crown cap. At this time, as the bottle B is held by both the inner end face 9*a* of the cap remover proper 1 and the bottle engaging surface 9*b* of arcuate shape at the lower end of the cap remover proper 1, the bottle remains stationary and accurate uncapping is ensured.

After uncapping, upon releasing the pusher 2 the lever 3 is urged toward its original state by the spring 6, the pusher 2 is lifted up by the spring S and the hooking member 4 is restored to its original state.

Figure 5A:
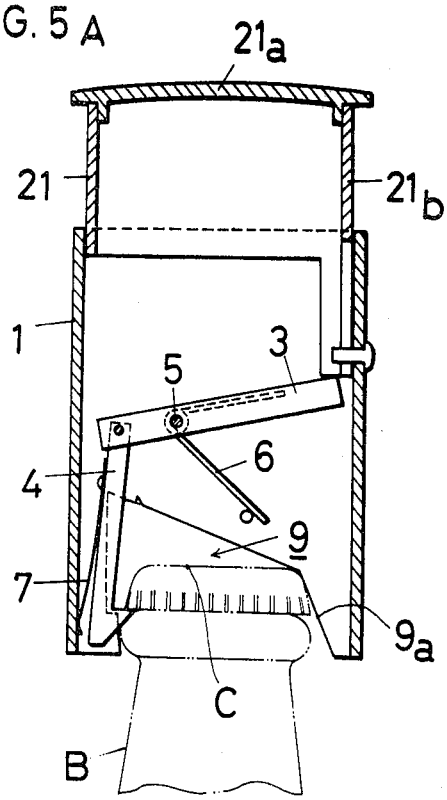
FIG. 5A is a view of an embodiment similar to that shown in FIG. 5B in the state of uncapping a bottle.
Figure 5B:
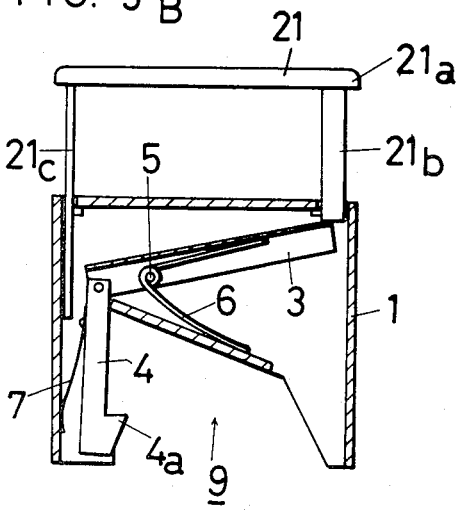
FIG. 5B is a longitudinal sectional view of a cap remover similar to that shown in FIG. 4.

The embodiments shown in FIG. 4, FIG. 5A and FIG. 5B are cap removers of such a type that a pusher 21 is inserted in the cap remover proper 1. In order to prevent the pusher 21 from being pushed entirely into the cap remover proper 1 entirely, a flange 21*a* is formed at the top of the pusher 21. A pushing down member 21*b* for pushing down the lever 3 protrudes at a lower end of the pusher 21. This pusher 21 can be of flat square tubular shape as shown in FIG. 4 and FIG. 5A or can be formed by a guide piece 21*c* and a pushing down member 21*b* which are provided oppositely at both sides of the lower end of the flange 21*a*. In the embodiments of this type, since the restoration of the pusher to its original state is effected simultaneously with the restoration of the lever 3 by means of the spring 6 provided at the support axle 5 of the lever 3, the spring S shown in FIG. 2 is not required. As is illustrated in FIG. 5A, cap C is held against the intersection of faces 9*a* and 9*c* which intersection acts as a fulcrum when the cap C is pried off the bottle B.

The embodiments shown in FIG. 6–FIG. 11 are of such a type that a lever is secured pivotally and directly to the cap remover proper, without using a pusher. However, the principle of uncapping in these embodiments are the same as that in the embodiments shown in FIG. 1–FIG. 5B.

Figure 6:
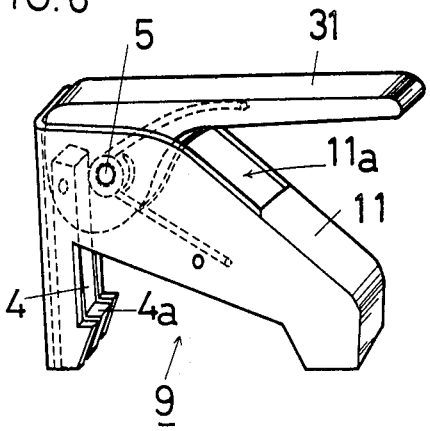
FIG. 6 is a perspective view of a another embodiment of the cap remover of the invention having a lever which is movable in relation to the remover proper.

Referring to FIG. 6–FIG. 9, a cap remover proper 11 has a vertically extending crown cap inserting groove 9 at the lower end portion thereof, similar to the embodiments shown in FIG. 1 and FIG. 4, but a lever 31 is partly inserted in a lever inserting groove 11*a* formed at top of cap remover proper 11 and is secured pivotally to the horizontal support axle 5. One end of the lever 31 is adapted to protrude above the cap remover proper 11 and the other end is pivotally connected to hooking member 4 by horizontal pin 8 fixed at opposite ends to cap remover proper 11. The spring 6 for restoring the lever 31 to its original state is supported by the support axle 5. Opposited ends of the spring 6 respectively press against the inner surface of the lever 31 and a spring stop pin horizontally mounted to the front and rear walls of cap remover 11. By the force of this spring 6 the lever 31 is held in such a state as shown in FIG. 6, so long as it is not subjected to external force or when such external force is removed.

Figure 9:
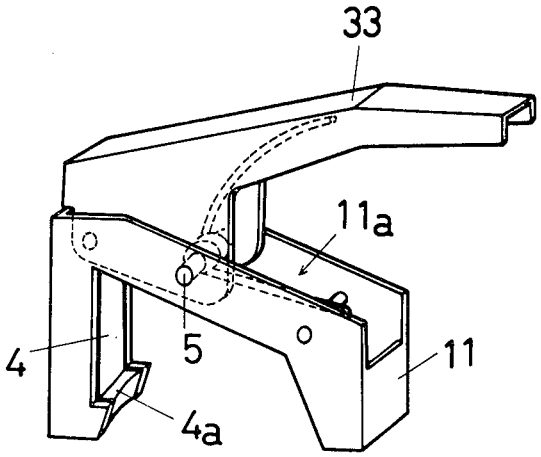
FIG. 8, FIG. 9 and FIG. 10 are respectively front views of cap remover of three embodiments of the lever pushing down type in accordance with the invention.
Figure 7:
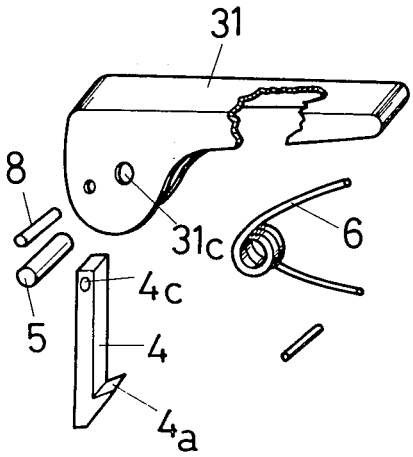
FIG. 7 is an exploded view of portions the cap remover shown in FIG. 6.
Figure 8:
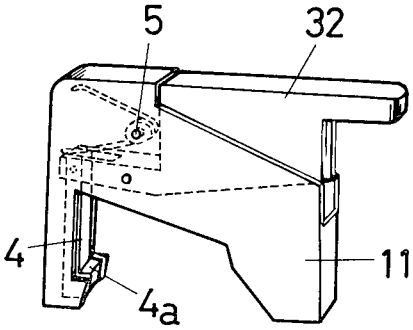

FIG. 8 and FIG. 9 show embodiments in which the shapes of the lever and the cap remover proper are somewhat different from those shown in FIG. 6 but are the same in their operation and result. The embodiment shown in FIG. 11 has a lever bent in L-shape. By squeezing together both the lever 35 and the cap remover proper 11, the lever 35 pivots so as to lift hooking member 4.

Figure 10:
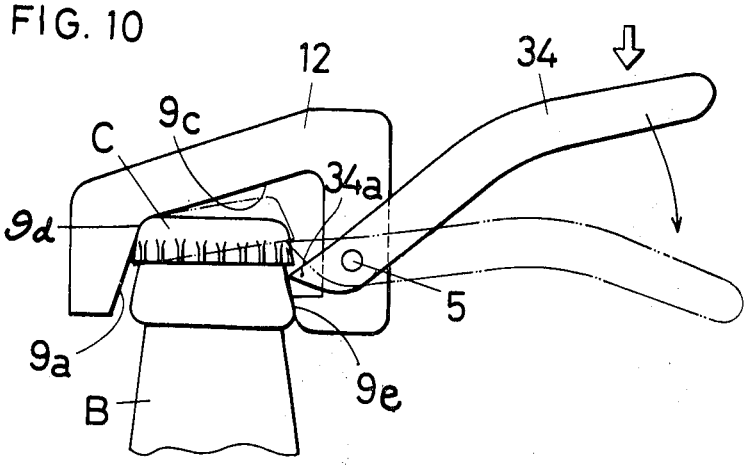
Figure 11:
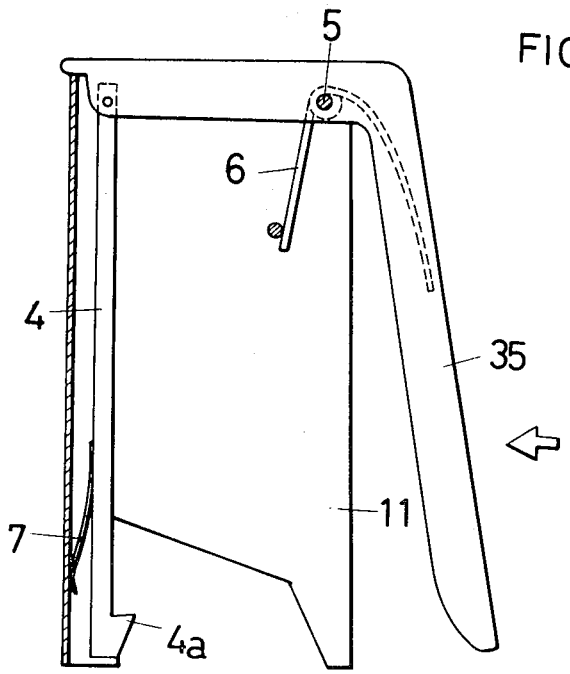
FIG. 11 is a front view of a cap remover of the lever gripping type.

The embodiment shown in FIG. 10 is of simpler construction than those shown in FIG. 6, FIG. 8 and FIG. 9, but in respect of the principle of uncapping it is the same as those shown in FIG. 1, FIG. 4, FIG. 5, FIG. 6, FIG. 8 and FIG. 9.

In FIG. 10, numeral 12 denotes a cap remover proper which is arranged on the diametrical line passing the center of a bottle mouth. It is made of metal thick enough to hold a crown cap tightly or of synthetic resin. The crown cap inserting groove of trapezoidal cutout shape 9 for holding a bottle mouth and a crown cap is formed at the lower side of the cap remover proper 12. This groove 9 is the same in shape as that shown in FIG. 1. At a bend 9*d* of groove 9 the top corner of the crown cap C is pressed and a projection 9*e* which presses against the mouth of the bottle B is provided at the inner surface of the opposite side of groove 9. When the crown cap C is inserted in the groove 9, the crown cap and the bottle mouth are respectively held by the bent 9*d* and the projection 9*e*. At this time, a lever 34 carrying at its top end a pawl 34*a* pivotally secured to the cap opener proper 12 by the support axle 5 is pivoted to such state as shown by a solid line in FIG. 10 so that the pawl 34*a* opposes the undersurface of the rim of the crown cap. Then, if the lever 34 is pushed down, the pawl 34*a* urges upwardly the undersurface of the rim of the crown cap whose top corner part is pressed and fixed by the bent 9*d* of the crown cap inserting groove 9, whereupon the crown cap is pried open by the pawl 34. At this time, since the bottle B is pressed by the pressing down force of the cap opener proper 12, the bottle is free from tilting and tumbling and there is no danger that the crown cap could fly off upon uncapping. The cap remover proper and the pusher in the above embodiments can also be of cylindrical shape.

Since the cap opener according to the present invention is of such construction as mentioned above, pressing down force from above a bottle is applied only to the top part of the bottle and therefore when a crown cap is being removed the bottle cannot be tilted or tumbled and the crown cap cannot fly off. Moreover, it has the advantage that uncapping can be effected easily with one hand.

What I claim is:

1. A cap remover for removing a cap having an exposed rim undersurface from the mouth of a bottle, comprising:

a main body having an opening in the bottom thereof for receiving the mouth of a bottle with a cap thereon, with main body including in said opening a lower surface and an upper surface above said lower surface for respectively engaging the mouth and the cap;

a lever pivotally mounted to said main body to pivot about a first axis; and a hooking member having a hook portion at a lower end thereof for engaging the rim undersurface of the cap pivotally mounted to said lever for pivoting about a second axis spaced from said first axis with said upper and lower surfaces respectively engaging the cap and the mouth of the bottle, whereby pivoting of said lever about said first axis lifts said hooking member upward with respect to said upper and lower surfaces to pry said cap from the said bottle.

2. A cap remover for removing a cap having an exposed rim undersurface from the mouth of a bottle, comprising:

a main body having an opening in the bottom thereof for receiving the mouth of a bottle with a cap thereon, said main body having sidewalls in said opening for engaging the mouth;

a lever pivotally mounted to said main body to pivot about a first axis;

a vertically moveable hooking member, having a hook portion at a lower end thereof for engaging in a cap engaging vertical position thereof the rim undersurface of the cap, pivotally mounted to said lever for pivoting relative to said lever about a second axis spaced from said first axis;

a pusher member vertically slidably connected to said main body, downwardly moveable in response to an externally applied downward force thereon;

means, responsive to downward movement of said pusher member from an initial vertical position, for pivoting said lever from an initial rotational position about said first axis to lift said hooking member upward from said cap engaging position to pry said cap from said bottle; and first spring means for restoring said pusher member, said lever and said hooking member to said initial vertical position, said initial rotational position and said cap engaging vertical position, respectively, when said hooking member is above said cap engaging vertical position and said external force is not being applied to said pusher.

3. The cap remover as in claim 2, wherein said pusher and said main body are rectangular in horizontal cross-section.

4. The cap remover as in claim 2, wherein said main body has an open top end, said pusher extending slidably into said main body through said open top end.

5. The cap remover as in claim 2, wherein said pusher is slidably mounted so as to cover a top end of said main body.

6. A cap remover for removing a cap having an exposed rim undersurface from the mouth of a bottle, comprising:

a main body having an opening in the bottom thereof for receiving the mouth of a bottle with a cap thereon, said main body including lower and upper internal surfaces forming boundaries of said opening shaped to hold the mouth and cap therein with said lower internal surface engaging the mouth and said upper internal surface engaging the cap;

a vertically moveable hooking member having an upper end and a lower end and a hook portion at said lower end for engaging in a cap engaging vertical position of said hooking member the rim undersurface of the cap;

a lever having an inner portion inside main body and a handle portion outside said main body pivotally mounted to said main body between said inside and outside portions and pivotally mounted to said hooking member at said upper end thereof, such that movement of said handle portion in a first rotational direction from a first rotational position with said lower and upper internal surfaces respectively engaging the mouth of the bottle and the cap lifts said hooking member with respect to said lower and upper internal surfaces to pry said cap from said bottle; and first spring means for urging said lever in a second rotational direction toward said first rotational position when said hooking member is above said cap engaging vertical position.

7. The cap remover as in claim 6, wherein said lever includes a horizontally extending portion across the top of said main body and a downwardly extending handle portion extending along a side of said main body, whereby squeezing said main body and handle portion together lifts said hooking portion upward.

8. The cap remover as in claims 2 or 6, wherein said upper internal surface includes a lower inclined face and an upper inclined face above said lower inclined face intersecting said lower inclined face at an angle, an upper edge of the cap being pivotally supported by said upper and lower inclined faces at the intersection between said upper and lower inclined faces, said upper and lower inclined faces at said intersection acting as a fulcrum when the cap is pried off the bottle.

9. The cap remover as in claim 8, wherein said upper and lower internal surfaces include a mouth engaging portion opposite and lower than said intersection.

10. The cap remover as in claim 9, said main body further having a vertically extending groove terminating at said mouth engaging portion for slidably receiving said hooking member.

11. The cap remover as in claim 10, further comprising second spring means for pressing said hook portion into engagement with said rim undersurface.

12. The cap remover as in claim 11, wherein said second spring means comprises a spring interposed in said vertically extending groove between said hooking member and a vertical boundary of said vertically extending groove.

* * * * *